US005427206A

United States Patent [19]

Powell et al.

[11] Patent Number: 5,427,206

[45] Date of Patent: Jun. 27, 1995

[54] ASSIGNING A HALL CALL TO AN ELEVATOR CAR BASED ON REMAINING RESPONSE TIME OF OTHER REGISTERED CALLS

[75] Inventors: Bruce A. Powell, Canton; Jannah Stanley, Cromwell; Bertram F. Kupersmith, Avon, all of Conn.; Masanori Sahara, Yamato; Paul Simcik, Kawasaki, both of Japan; Zuhair S. Bahjat, Farmington, Conn.

[73] Assignee: Otis Elevator Company, Farmington, Conn.

[21] Appl. No.: 326,157

[22] Filed: Oct. 19, 1994

Related U.S. Application Data

[63] Continuation of Ser. No. 812,189, Dec. 10, 1991, abandoned.

[51] Int. Cl.[6] ..... B66B 1/18

[52] U.S. Cl. ..... 187/387; 187/382

[58] Field of Search ..... 187/380, 382, 387, 391

[56] References Cited

U.S. PATENT DOCUMENTS

| | | | |
|---|---|---|---|
| 4,043,429 | 8/1977 | Hirasawa et al. | 187/127 |
| 4,638,889 | 1/1987 | Ludwig et al. | 187/387 |
| 4,760,896 | 8/1988 | Yamaguchi | 187/124 |
| 4,793,443 | 12/1988 | MacDonald et al. | 187/124 |
| 4,815,568 | 3/1989 | Bittar | 187/387 |
| 5,146,053 | 9/1992 | Powell et al. | 187/127 |
| 5,183,981 | 2/1993 | Thangavelu | 187/128 |

*Primary Examiner*—Thomas M. Dougherty
*Assistant Examiner*—Robert Nappi

[57] ABSTRACT

Assignment of a hall call to an elevator car occurs only if servicing the hall call will not have an adverse effect on the response times of other registered calls for the car. Assignment of a hall call is made to the car having the lowest number of registered calls which cross a predetermined response time threshold in response to servicing the call.

8 Claims, 2 Drawing Sheets

ASSIGNING A HALL CALL TO AN ELEVATOR CAR BASED ON REMAINING RESPONSE TIME OF OTHER REGISTERED CALLS

DESCRIPTION

This is a continuation of application Ser. No. 07/812,189, filed on Dec. 10, 1991, now abandoned.

TECHNICAL FIELD

This invention relates to the field of elevator car dispatching.

BACKGROUND ART

Elevator dispatching software causes a particular elevator car in a bank of elevators to be sent to a floor in response to a user pressing a hall call button at that floor. Traditionally, a hall lantern will illuminate just prior to the car doors opening in order to inform the user as to which car will service his call. The dispatching software chooses which car to assign to the call according to a variety of elevator system parameters, such as average waiting time, maximum waiting time, average travel time, etc. It is possible for the values of these system parameters to change between the time the call is registered and the time the call is serviced. Therefore the software may reassign the call to other cars many times before the call is serviced. The user does not notice the reassignment because the hall lantern is lit only just before the car arrives.

Unlike traditional car assignment techniques, instantaneous car assignment (ICA) informs a user instantaneously (or shortly thereafter) as to which car will service his hall call. The ICA assignment technique is more demanding in that it is not acceptable to repeatedly reassign different cars to a hall call since this will cause continuous lighting and unlighting of hall lanterns causing confusion for the hall passengers. Accordingly, it is important to provide an initial assignment that is as good as possible. This includes determining the effect of a hall call on other registered calls for the elevator car.

DISCLOSURE OF INVENTION

Objects of the invention include improved assignment of an elevator car to a hall call.

According to the present invention, a car is assigned to service a hall call only if servicing the hall call will not cause the remaining response times of any calls for the car to exceed a predetermined threshold. According further to the present invention, a hall call is assigned to a car having the lowest number of remaining response times of other registered calls that servicing the hall call would cause to go from below a predetermined value to above a predetermined value.

The foregoing and other objects, features and advantages of the present invention will become more apparent in light of the following detailed description of exemplary embodiments thereof, as illustrated in the accompanying drawings.

BEST MODE FOR CARRYING OUT THE INVENTION

Figure 1:
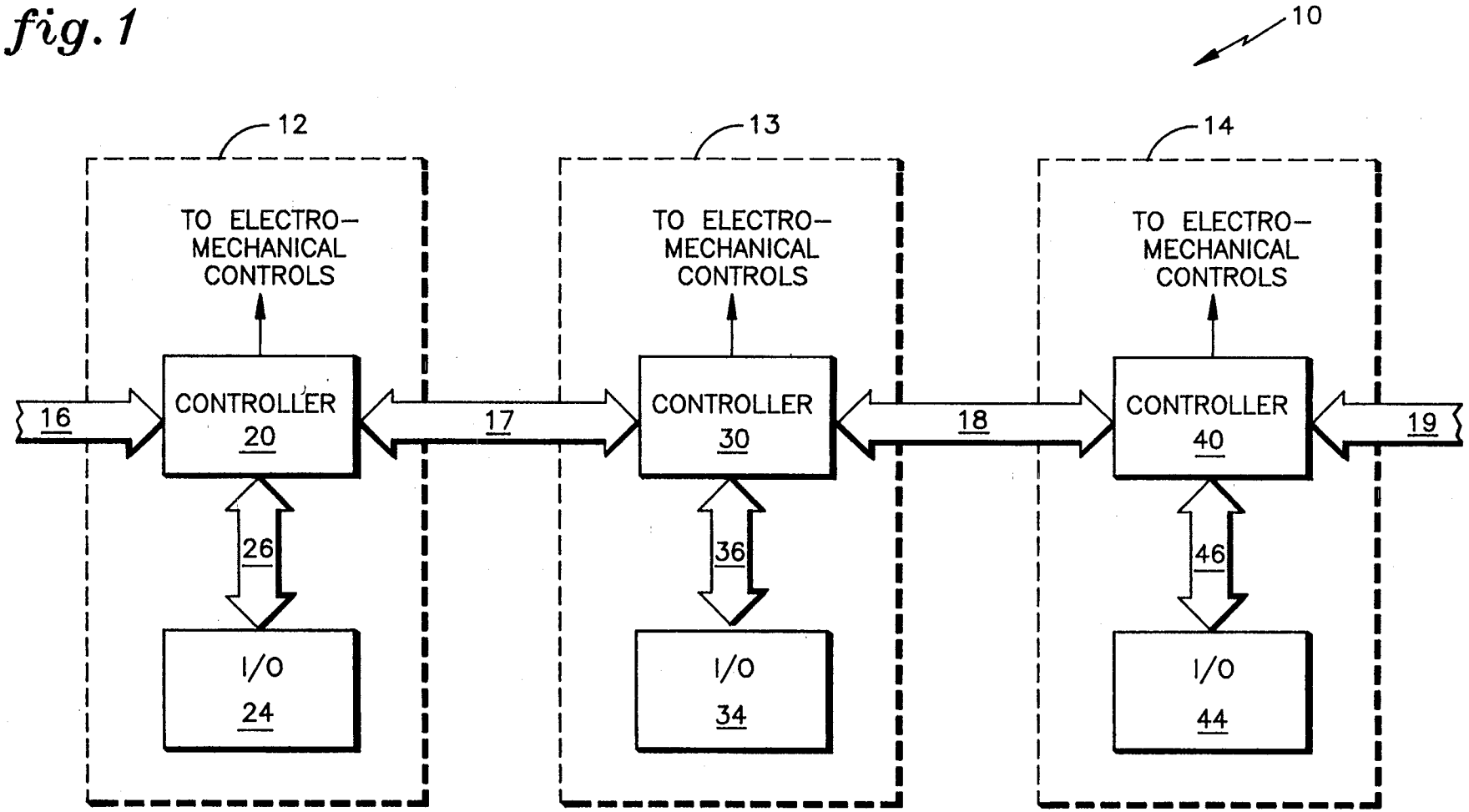
FIG. 1 is a schematic block diagram of an elevator system.

Referring to FIG. 1, an elevator group 10 comprises a first elevator 12, a second elevator 13, and a third elevator 14. Digital communication between the elevators 12–14 is provided by interelevator communication links 16–19, which are implemented by means known to those skilled in the art. The group 10 may also be composed of other elevators (not shown) which communicate with the first and third elevators 12, 14 via the interelevator communication links 16, 19 attached thereto. A remote elevator communications interface (not shown), which provides for interfacing the group 10 with a remote computer, may also be used.

The first elevator 12 comprises a microprocessor-based controller 20 which provides signals to electromechanical controls (not shown) for actuating electromechanical devices (not shown) that move an elevator car (not shown). The controller 20 also sends and receives signals to and from elevator input/output devices 24, such as hall and car call buttons, hall lanterns, floor indicators, etc. via an intraelevator communications link 26, the implementation of which is known to those skilled in the art. The second and third elevators 13, 14 are similarly configured with microprocessor based controllers 30, 40, input/output devices 34, 44, and intraelevator communications links 36, 46.

Elevator control and dispatching is implemented using software embedded in ROMs (not shown) in the controllers 20, 30, 40 and executed by microprocessors (not shown) also located within the controllers 20, 30, 40. The software receives and processes signals from the input/output devices 26, 36, 46, such as car and hall call buttons, and provides signals for actuating electromechanical controls to move the cars to various floors.

When a hall call is registered, a signal is sent to each of the controllers 20, 30, 40 via either the intraelevator communication links 26, 36, 46 or via the interelevator communication links 16–19. In response to a hall call signal, the controllers 20, 30, 40 execute software to determine which of the cars of the elevators 12–14 will service the hall call. Signals indicative of parameters of the elevator group 10, which are used by the software to determine the assignment, are passed among the elevators 12–14 via the interelevator communication links 16–19.

Figure 2:
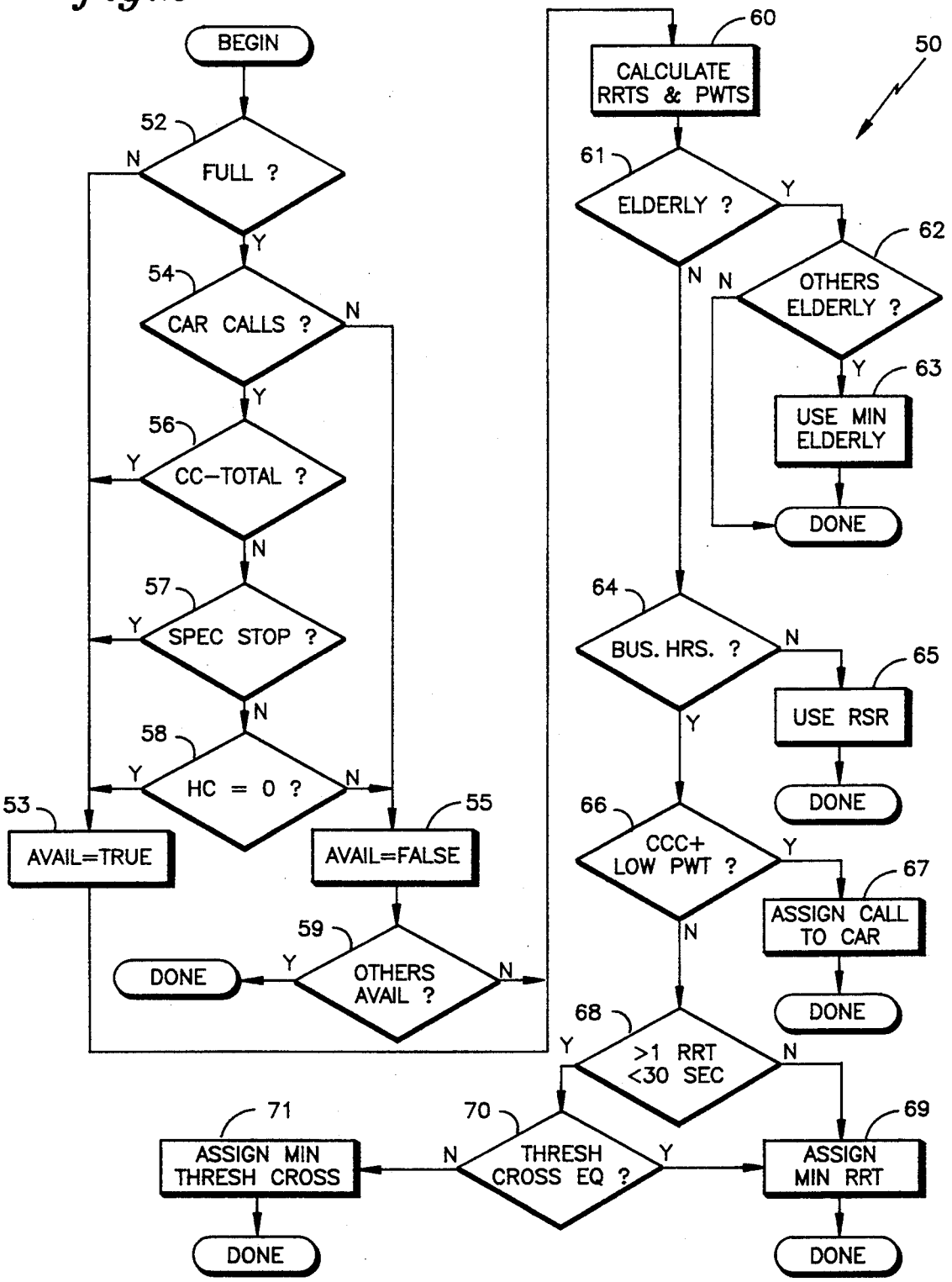
FIG. 2 is a flowchart indicating steps for assigning an elevator car.

Referring to FIG. 2, a flowchart 50 illustrates the process of assigning an elevator car to service a hall call. At a first step 52, a test is made to determine if the elevator car is full. This information is provided by sensors (not shown) and software (not shown), known to those skilled in the art, which determines the number of passengers in an elevator car. If the car is not full, control passes from the step 52 to a step 53, where a variable AVAIL is set to TRUE, indicating the elevator car is available to service a hall call. The value of the AVAIL variable for each elevator car is made available to all of the elevators 12–14 via the interelevator communication links 16–19.

If at the step 52 the car is full, control passes from the step 52 to a step 54, where a test is made to determine if there are any car calls between the present position of the elevator car and the hall call, inclusive of the position of the hall call. If there are no car calls between the present position of the elevator car and the hall call, control passes from the step 54 to a step 55 where the variable AVAIL is set to FALSE, indicating that the car is not available to answer the hall call. Note that if the car is full and there are no car calls between the position of the car and the hall call (to empty the car out) then there is no possibility of the car not being full at the time it would answer the hall call.

If at the test step 54 there are car calls between the present position of the elevator car and the hall call, control passes from the step 54 to a test step 56, where a test is made to determine if all of the car calls are between the position of the elevator car and the hall call, inclusive of the position of the hall call. If all of the car calls are between the position of the elevator car and the hall call, there is a good chance that the car will be empty or nearly empty at the hall call so control passes from the step 56 to the step 53, where the AVAIL variable is set to TRUE.

If, on the other hand, all of the car calls are not between the position of the elevator car and the hall call, control passes from the step 56 to a step 57, where a test is made to determine if there is a special stop car call between the current position of the car and the hall call. A special stop is a cafeteria, lobby, or any other stop where one could normally expect many passengers to exit from the elevator car. If there is a special stop between the current elevator car position and the hall call, the elevator car is deemed available for a hall call and control passes from the step 57 to the step 53. Otherwise, control passes from the step 57 to a step 58, where a test is made to determine if the number of hall calls between the current position of the elevator car and the hall call is zero. If so, then the elevator car is deemed available, and control passes from the step 58 to the step 53. If not, then the elevator car is deemed not available and control passes from the step 58 to the step 55.

Following the step 55, where AVAIL is set to FALSE indicating that the elevator car is not available for assignment to a hall call, is a test step 59, where a test is made to determine if any of the other cars in the group are available. If at least one other car is available, processing is complete and the hall call will be assigned to one of the available cars. If, on the other hand, all of the cars in the group are unavailable, then an assignment will be made to one of the cars in spite of the unavailability of any of the cars.

Following the test step 59 if no other cars in the group are available or following the step 53 is a step 60, where the remaining response times (RRT) for all of the registered calls for the car, including the present hall call, are determined. RRT is a prediction of the amount of time which will elapse before a hall call is serviced. RRT makes use of the following estimates: A car in motion will take one second to travel from a floor to an adjacent floor, a stopped car will take five seconds to begin moving and reach an adjacent floor, a stop will take ten seconds for passengers to load and unload, and answering a hall call will result in a car call to a terminal floor ending in the direction of the hall call. The RRT for a call is thus determined by summing the time values from the above assumptions. Remaining response time is an estimation of the amount of time required for an elevator to reach the floor at which the hall call is registered given the car calls and hall calls (or simply calls) to which the elevator car is committed.

At the step 60, the hall call is assumed to have been assigned to the car before the new RRTs for all of the registered calls for the car are determined. The predicted waiting time (PWT) for each of the calls is also determined. PWT is calculated by adding the RRT of a call to the amount of elapsed time since the call was registered. Calls which have a PWT greater than a predetermined amount of time, such as sixty seconds, are deemed "elderly". Cars having elderly calls are treated specially, as described in more detail hereinafter.

Following the step 60 is a test step 61, where all of the registered calls for the car are examined to determine if the car has any affected elderly calls which are calls that are made elderly or made more elderly by answering the hall call. If so, control passes from the step 61 to a test step 62 where the state of the other cars is examined to determine if all of the other cars have any affected elderly calls. The existence and duration of affected elderly calls for all of the cars is passed among the elevators 12–14 via the interelevator communication links 16–19. If not all of the other calls have affected elderly calls, then processing is complete since the hall call will be assigned to one of the other cars which does not have an affected elderly call. Otherwise (i.e., if all of the cars have affected elderly calls), control passes to a step 63 where the maximum affected elderly call for each of the cars is examined. At the step 63, the call is assigned to the car having the smallest maximum affected elderly call.

If at the test step 61 there are no affected elderly calls for the car, control passes from the step 61 to a test step 64 where the current time of day is checked against values which define business hours (nominally seven A.M. to seven P.M.). If the time of day is not within business hours, control passes from the step 64 to a step 65, where the relative system response (RSR) elevator call assignment algorithm is used to determine assignment of the hall call. The RSR algorithm is known in the art and is described fully in a patent to Joseph Bittar titled "Relative System Response Elevator Call Assignments", U.S. Pat. No. 4,363,381.

If the time of day is within business hours, control passes from the step 64 to a test step 66 where the registered car calls are examined for a car call coincident with the hall call. If there is a coincident car call (CCC), and if the PWT of the call is a relatively low amount of time (such as forty-five seconds or less), control passes from the step 66 to a step 67, where the call is assigned to the car having the coincident car call and low PWT. If more than one car has a coincident car call and low PWT, the car with the lowest PWT is chosen from among those cars.

If there are no cars with a coincident car call and low PWT, control passes from the step 66 to a step 68, where a test determines if there is more than one car with an RRT for the call of less than thirty seconds. If not, control passes from the step 68 to a step 69, where the car with the minimum RRT for the call is assigned to service the call. For all of the cars, the RRT for the hall call is passed among the elevators 12–14 via the interelevator communication links 16–19.

If there is more than one car with an RRT less than thirty seconds, control passes from the step 68 to a step 70, where a comparison is made of the numbers of threshold crossings for the cars with RRTs for the hall call that are less than thirty seconds. A threshold crossing occurs when servicing a hall call would cause the RRT for other registered calls to go from less than a predetermined amount to greater than the same amount, such as thirty seconds. The threshold crossings for all of the cars are passed among the elevators 12–14 via the interelevator communication links 16–19.

If the minimum number of threshold crossings are equal for two or more cars, control passes from the step 70 to the step 69, where the hall call is assigned to one of the cars with equal numbers of threshold crossings having the minimum RRT for the hall call. If there is only a single car having the minimum number of threshold crossings, control passes from the step 70 to a step 71, where the hall call is assigned to the car with the minimum number of threshold crossings.

The invention illustrated herein is applicable to any elevator system having any number of cars, stopping on any number of floors, having any maximum capacity, maximum velocity, or having any other specific set of physical characteristics. Similarly, the invention may be practiced irrespective of the physical design of the elevator system, including drives, counterweights, cabling, door mechanisms, hall call and car call signaling devices. The examples of special stops used herein are not meant to be exhaustive.

The particular values used for deeming a call elderly, for determining a threshold crossing, and for other specific purposes may be modified by one skilled in the art without departing from the spirit and scope of the invention. The invention may be adapted by one skilled in the art to be used for reassignment of previously assigned hall calls. The exact methodology and times used for determining RRT may be modified without departing from the spirit and scope of the invention.

Portions of the processing illustrated herein may be implemented instead with electronic hardware, which would be straightforward in view of the hardware/software equivalence discussed (in another field) in U.S. Pat. No. 4,294,162 entitled "Force Feel Actuator Fault Detection with Directional Threshold" (Fowler et al.).

Although the invention has been shown and described with respect to exemplary embodiments thereof, it should be understood by those skilled in the art that various changes, omissions and additions may be made therein and thereto, without departing from the spirit and the scope of the invention.

What is claimed is:

1. A method of dispatching a plurality of elevator cars operating as a group in a building, including assigning hall calls to said cars for service, comprising:

providing, for each hall call which is already assigned to be serviced by a car, a first predicted waiting time signal indicative of the predicted time before said already-assigned call will be serviced by the assigned car if no other hall calls are assigned to such car;

for each unassigned hall call that is to be assigned, providing for each one of said cars which is available to service said unassigned hall call, a remaining response time signal indicative of the estimated time it will take for said one car to reach said call, and a plurality of second predicted waiting time signals, one for each of said already assigned hall calls, each indicative of the predicted time that it will take for the corresponding hall call to be serviced by said one car if said unassigned hall call is assigned to said one car;

identifying as an affected elderly call signal, each of said second predicted waiting time signals that indicates a waiting time which is both greater than the waiting time indicated by the corresponding one of said first predicted waiting time signals for the same already-assigned hall call and greater than a predetermined first threshold amount of time;

determining if any of said available cars have no affected elderly call signal corresponding thereto and if so, assigning said hall call to one of said available cars for which there is no corresponding affected elderly call signal; and dispatching said available cars to respond to hall calls.

2. A method according to claim 1 wherein said step of determining and assigning includes:

if all of said available cars have an affected elderly call signal corresponding thereto, determining for each of said available cars, the maximum waiting time indicated by any of its second predicted waiting time signals corresponding to an affected elderly call signal, and assigning said hall call to the one of said cars for which its maximum waiting time is less than the maximum waiting time determined for any other ones of said available cars.

3. A method according to claim 1 wherein said step of determining and assigning includes:

assigning said hall call to one of said available cars for which there is no corresponding affected elderly call signal and which also has a car call coincident with said hall call and the predicted waiting time for said one car to respond to said hall call is below a second predetermined threshold amount of time, if any.

4. A method according to claim 3 wherein said step of determining and assigning includes:

if there is no car with a coincident car call and predicted waiting time below said second predetermined threshold of time, determining if there is more than one of said available cars which has a remaining response time predicted for said hall call less than a third predetermined threshold amount of time, and if not, assigning said hall call to the one of said available cars having the minimum response time predicted for said hall call.

5. A method according to claim 3 wherein said step of determining and assigning includes:

if there is no car with a coincident car call and predicted waiting time below said second predetermined threshold of time, determining if there is more than one of said available cars which has a remaining response time predicted for said hall call less than a third predetermined threshold amount of time, and if so, assigning said hall call to the one of said cars for which assignment to respond to said hall call results in the minimum number of its assigned calls having a remaining response time in excess of a fourth predetermined threshold amount of time, if any.

6. A method according to claim 5 wherein said step of determining and assigning includes:

if there is more than one car having the same minimum number of calls for which assignment of said hall call to the car results in remaining response times in excess of said fourth predetermined threshold amount of time, assigning said hall call to the one of said available cars having the minimum response time predicted for said hall call.

7. A method according to claim 1 wherein said step of determining and assigning includes:

determining the relative system response with respect to said hall call, of each of said available cars for which there is no corresponding affected elderly call signal and assigning said hall call to the one of said cars having the lowest relative system response.

8. A method according to claim 1 wherein said step of determining and assigning includes:

if the current time of day is within normal business hours, assigning said hall call to one of said available cars for which there is no corresponding affected elderly call signal and which also has a car call coincident with said hall call and the predicted waiting time for said one car to respond to said hall call is below a second predetermined threshold amount of time, if any;

but if the current time of day is outside normal business hours, determining the relative system response with respect to said hall call, of each of said available cars for which there is no corresponding affected elderly call signal and assigning said hall call to the one of said cars having the lowest relative system response.

* * * * *